US009338566B2

(12) United States Patent
Flynn et al.

(10) Patent No.: US 9,338,566 B2
(45) Date of Patent: May 10, 2016

(54) METHODS, SYSTEMS, AND DEVICES FOR DETERMINING A BINAURAL CORRECTION FACTOR

(71) Applicants: Mark C. Flynn, Wuustwezel (BE); Tracey Adams, Addlestone (GB)

(72) Inventors: Mark C. Flynn, Wuustwezel (BE); Tracey Adams, Addlestone (GB)

(73) Assignee: Cochlear Limited, Macquarie University (AU)

( * ) Notice: Subject to any disclaimer, the term of this patent is extended or adjusted under 35 U.S.C. 154(b) by 324 days.

(21) Appl. No.: 13/836,066

(22) Filed: Mar. 15, 2013

(65) Prior Publication Data

US 2014/0270190 A1 Sep. 18, 2014

(51) Int. Cl.
*H04R 25/00* (2006.01)

(52) U.S. Cl.
CPC ..... *H04R 25/552* (2013.01); *H04R 2430/01* (2013.01)

(58) Field of Classification Search
None
See application file for complete search history.

(56) References Cited

U.S. PATENT DOCUMENTS

| | | | | |
|---|---|---|---|---|
| 6,449,372 | B1 | 9/2002 | Greminger | |
| 2003/0144603 | A1* | 7/2003 | Zoth et al. | 600/559 |
| 2005/0018858 | A1* | 1/2005 | John | 381/60 |
| 2008/0253595 | A1 | 10/2008 | Steinbuss | |
| 2009/0030484 | A1 | 1/2009 | Chambers | |
| 2010/0002887 | A1 | 1/2010 | Roeck et al. | |
| 2010/0041940 | A1 | 2/2010 | Hillbratt et al. | |
| 2010/0111338 | A1 | 5/2010 | Ypma et al. | |
| 2011/0071339 | A1 | 3/2011 | Rosenbom | |
| 2013/0085411 | A1* | 4/2013 | Van Tasell | 600/559 |
| 2013/0208896 | A1* | 8/2013 | Chatlani et al. | 381/17 |
| 2015/0018699 | A1* | 1/2015 | Zeng et al. | 600/509 |

FOREIGN PATENT DOCUMENTS

CA 2707284 A1 12/2011

* cited by examiner

*Primary Examiner* — Curtis Kuntz
*Assistant Examiner* — Kenny Truong
(74) *Attorney, Agent, or Firm* — McDonnell Boehnen Hulbert & Berghoff LLP

(57) ABSTRACT

Methods, systems, and devices are disclosed herein. A sample method includes determining one or more binaural correction factors at one or more frequencies. Each binaural correction factor is representative of an amount of binaural summation experienced by a recipient of a binaural stimulus at one of the one or more frequencies. The binaural stimulus is delivered about simultaneously to the recipient by a first stimulation device and a second stimulation device.

14 Claims, 5 Drawing Sheets

METHODS, SYSTEMS, AND DEVICES FOR DETERMINING A BINAURAL CORRECTION FACTOR

BACKGROUND

Due to hearing loss, some individuals have difficulty perceiving or are unable to perceive sound. In order to perceive at least a portion of a sound, these individuals may benefit from the use of a hearing prosthesis. Certain hearing prostheses are designed to assist users having specific types of hearing loss. In a binaural (or bilateral) hearing prosthesis system, a recipient employs a first hearing prosthesis for one of the recipient's ears and a second hearing prosthesis for the recipient's other ear.

The effectiveness of the binaural hearing prostheses depends on the type and severity of a user's hearing loss. Depending on the hearing prostheses employed, the recipient may perceive sound as a person with normal hearing, or the binaural hearing prostheses may allow the recipient to perceive a portion of the sound. For instance, binaural hearing prostheses may allow the recipient to better localize sounds and/or recognize speech in noisy environments. The effectiveness of the binaural hearing prostheses also depends on how well the prostheses are configured for, or "fitted" to, a recipient of the hearing prostheses. Fitting the binaural hearing prostheses, sometimes also referred to as "programming," "calibrating," or "mapping," creates a set of control settings and other data that define the specific characteristics of the stimuli (in the form of acoustic, mechanical, or electrical signals) delivered to the relevant portions of the person's outer ear, middle ear, inner ear, auditory nerve, or other body part. The settings are based in part on the recipient's ability to perceive sounds at one or more frequencies. This configuration information is sometimes referred to as the user's "program" or "map."

SUMMARY

A method is provided. The method includes determining one or more binaural correction factors at one or more frequencies. Each binaural correction factor is representative of an amount of binaural summation experienced at one of the one or more frequencies by a recipient of a binaural stimulus. The binaural stimulus is delivered about simultaneously to the recipient by a first stimulation device and a second stimulation device.

A non-transitory computer-readable memory having stored therein instructions executable by a computing device to cause the computing device to perform functions is also provided. The functions include determining a plurality of monaural threshold intensities corresponding to a plurality of monaural stimuli. The functions also include determining a plurality of binaural threshold intensities corresponding to a plurality of binaural stimuli. The functions additionally include calculating a plurality of binaural correction factors. For a frequency included in the plurality of frequencies, a difference between the monaural threshold intensity at the frequency and the binaural threshold intensity at the frequency is the binaural correction factor at the frequency.

A system is provided. The system includes a first stimulation device. The system also includes a second stimulation device. The system additionally includes a computing device connected to the first stimulation device and the second stimulation device. The computing device is configured to cause the first stimulation device to deliver a binaural stimulus at about the same time as the second stimulation device delivers the binaural stimulus. The computing device is also configured to adjust an intensity of the binaural stimulus to identify a lowest intensity of the binaural stimulus at which the recipient is able to perceive the sound. The lowest intensity of the binaural stimulus is a binaural threshold intensity for the first stimulation device and the second stimulation device at the one or more frequencies.

A device is provided. The device includes a processor. The processor is configured to determine a binaural threshold intensity for binaural stimulation devices at a frequency channel. The processor determines the binaural threshold intensity based on whether a recipient perceives a sound at a frequency corresponding to the frequency channel in response to receiving one or more binaural stimuli. The binaural threshold intensity is an intensity of a binaural stimulus below which the recipient is unable to perceive the sound.

These as well as other aspects and advantages will become apparent to those of ordinary skill in the art by reading the following detailed description, with reference where appropriate to the accompanying drawings. Further, it is understood that this summary is merely an example and is not intended to limit the scope of the invention as claimed.

BRIEF DESCRIPTION OF THE FIGURES

Presently preferred embodiments are described below in conjunction with the appended drawing figures, wherein like reference numerals refer to like elements in the various figures, and wherein.

DETAILED DESCRIPTION

The following detailed description describes various features, functions, and attributes of the disclosed systems, methods, and devices with reference to the accompanying figures. In the figures, similar symbols typically identify similar components, unless context dictates otherwise. The illustrative embodiments described herein are not meant to be limiting. It will be readily understood that the aspects of the present disclosure, as generally described herein, and illustrated in the figures, can be arranged, substituted, combined, separated, and designed in a wide variety of different configurations, all of which are contemplated herein.

Certain types of auditory prostheses, commonly referred to as bone conduction devices, convert a received sound into vibrations. The vibrations are transferred through teeth and/or bone to the cochlea, causing generation of nerve impulses, which result in a perception of the received sound. Bone conduction devices are suitable to treat a variety of types of hearing loss and may be suitable for individuals who cannot derive sufficient benefit from other hearing prostheses or aid, such as acoustic hearing aids and cochlear implants, or for individuals who suffer from stuttering problems.

Figure 1:
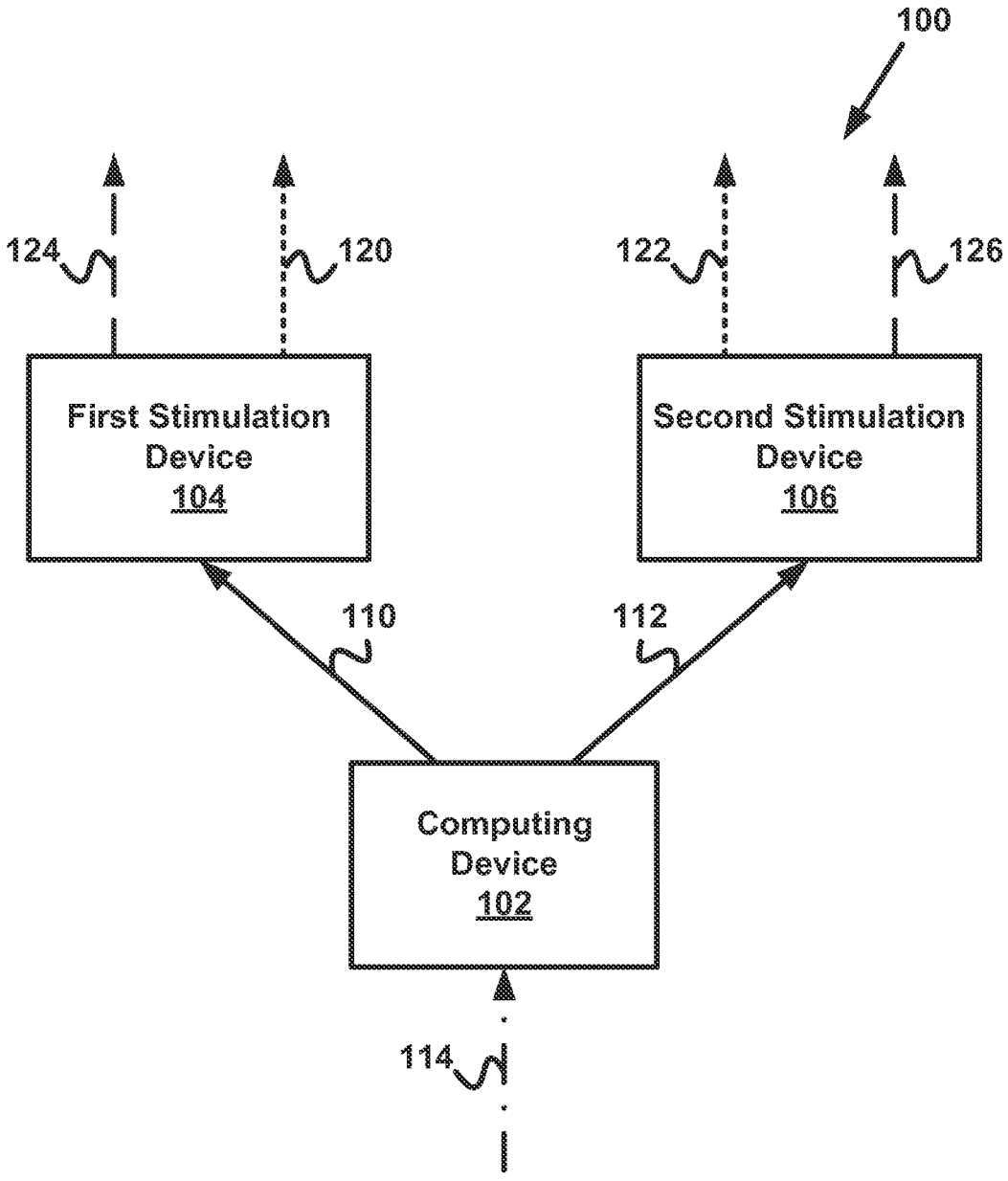
FIG. 1 is a block diagram of a system for determining threshold intensities of stimuli delivered to a recipient, according to an example.

FIG. 1 is a block diagram of a system 100 configured to determine threshold intensities of stimuli delivered to a recipient. The system 100 includes a computing device 102, a first stimulation device 104, and a second stimulation device 106. A user—such as an audiologist or similar professional—uses the system 100 to deliver stimuli to the recipient in order to determine one or more threshold intensities at one or more frequencies. A threshold intensity is an intensity of a stimulus, at a given frequency, below which the recipient is unable to perceive a sound (e.g., a tone, warble, chirp, etc.).

The computing device 102 is connected to the first stimulation device 104 via a first communication link 110. Similarly, the computing device 102 is connected to the second stimulation device 106 via a second communication link 112. The computing device 102 sends a command signal to one or both of the stimulation devices 104, 106 via the respective communication links 110, 112. The command signal includes information indicative of an intensity (or intensities) and frequency (or frequencies) of a stimulus that one or both of the stimulation devices 104, 106 is to deliver to the recipient. In one example, the communications links 110, 112 are wired links. In another example, the communication links 110, 112 are wireless links, such as Wi-Fi™ links and/or Bluetooth® links. In yet another example, the communication links 110, 112 are any type of communication link or combination of communication links now known or later developed that is suitable for connecting the computing device 102 to the stimulation devices 104, 106.

The first stimulation device 104 and the second stimulation device 106 are configured to deliver stimuli to a body part in the recipient's auditory pathways. As used herein, the term "auditory pathway" refers to body parts in a human (or other mammalian) body, such as a portion of the skull, an ossicular chain, a cochlea, and an auditory nerve, that, when stimulated, cause the recipient to perceive at least a portion of a sound. Thus, the first stimulation device 104 delivers a stimulus to a body part in a first auditory pathway (e.g., the recipient's left auditory pathway) and the second stimulation device 106 delivers a stimulus to a body part in a second auditory pathway (e.g., the recipient's right auditory pathway).

In a post-operative setting, the stimulation devices 104, 106 are bilateral hearing prostheses. An audiologist uses the system 100 to calibrate, or "fit," the stimulation devices 104, 106 to the recipient. That is, the audiologist uses the system 100 to determine a setting of one or more parameters used by the stimulation devices 104, 106 to process sounds received from the environment. In one example, the stimulation devices 104, 106 are bone conduction devices. In another example, the stimulation devices 104, 106 are cochlear implants, direct acoustic stimulation devices, brain stem implants, middle ear implants, and/or any other type of hearing prostheses or combination of hearing prostheses now known or later developed suitable for use in a binaural hearing prosthesis system.

During the fitting process, the computing device 102 determines one or more monaural threshold intensities for monaural stimuli 120, 122 delivered to the recipient by the first stimulation device 104 and the second stimulation device 106, respectively. A monaural stimulus is a stimulus delivered to the recipient from one of the stimulation devices 104, 106. A monaural threshold intensity at a given frequency is an intensity of a monaural stimulus below which the recipient is unable to perceive a sound at the given frequency.

The computing device 102 determines the monaural threshold intensity at one or more frequencies for each of the stimulation devices 104, 106. To determine a monaural threshold intensity, the computing device 102 sends a command signal to one of the stimulation devices 104, 106. In response to receiving the command signal, the stimulation device 104 (106) generates a monaural stimulus 120 (122), which has the intensity (or intensities) and frequency (or frequencies) indicated in the command signal, and delivers the monaural stimulus 120 (122) to the recipient.

The computing device 102 then receives an input 114 that includes information indicative of the recipient's perception of the sound. In one example, the computing device 102 receives the input 114 from the audiologist or other user of the computing device 102. In this example, the input 114 indicates whether the recipient did or did not perceive the sound after receiving the monaural stimulus 120 (122). Additionally or alternatively, the computing device 102 receives the input 114 from an external device (not shown) that is configured to measure the recipient's perception based on measured neurological activity. Here, the input 114 includes information indicative of whether recipient perceived the sound and/or information indicative of the measured neurological activity.

Depending on the recipient's perception, the computing device 102 adjusts the intensity of the monaural stimulus 120 (122) until the monaural threshold intensity at the frequency for the stimulation device 104 (106) is determined. The computing device 102 is configured to adjust the intensity of monaural stimulus 120 (122) by appropriately adjusting the command signals sent to the first stimulation device 104 (second stimulation device 106) to provide the desired output by the first stimulation device 104 (second stimulation device 106).

The computing device 102 is also configured to determine one or more binaural threshold intensities for a first binaural stimulus 124 and a second binaural stimulus 126. A binaural stimulus is a stimulus that is delivered about simultaneously to the recipient by both of the stimulation devices 104, 106. In other words, first binaural stimulus 124 is essentially the same as the second binaural stimulus 126; an intensity and a frequency of the first binaural stimulus 124 are the same as or substantially similar to an intensity and frequency of the second binaural stimulus 126. A binaural threshold intensity at a given frequency is an intensity of a binaural stimulus below which the recipient is unable to perceive sound at the given frequency.

The computing device 102 determines the binaural threshold intensity at one or more frequencies for the stimulation devices 104, 106. To determine a binaural threshold frequency, the computing device 102 sends a command signal to both stimulation devices 104, 106. Receiving the command signal causes the first stimulation device 104 to deliver the first binaural stimulus 124 to the recipient at about the same time as the second stimulation device 106 delivers the second binaural stimulus 126 to the recipient.

The computing device 102 then receives the input 114, which includes information indicative of the recipient's perception of the sound after receiving the binaural stimuli 124, 126. As with determining the monaural threshold intensities for the stimulation device 104, 106, the computing device 102 receives the input 114 from the audiologist (or other user of the computing device 102) and/or the external unit (not shown) configured to measure neurological activity in the recipient.

Depending on the recipient's perception, the computing device 102 adjusts the intensity of the binaural stimuli 124, 126 until the monaural threshold intensity at the frequency for the stimulation device is determined. The computing device 102 is configured to adjust the intensity of binaural stimuli 124, 126 by appropriately adjusting the command signals sent to the stimulation devices 104, 106 to provide the desired output by the stimulation devices 104, 106.

Determining a monaural threshold intensity and a binaural threshold intensity at a frequency allows the computing device 102 to determine a binaural correction factor at that frequency. The binaural correction factor is the difference between the monaural threshold intensity and the binaural threshold intensity at a given frequency, and is indicative of the effect of "leakage" that occurs at the given frequency. Leakage refers to a phenomenon that occurs when a body part in an auditory pathway receives certain stimuli, such as electro-mechanical stimuli, that are or are nearly equivalent.

For example, consider a situation in which the stimulation devices 104, 106 deliver the binaural stimuli 124, 126 to the recipient. Depending on the stimulus, a portion of the second binaural stimulus may, at some frequencies, propagate, or leak, through a medium (e.g., the recipient's skull) such that the body part in the first auditory pathway receives the first binaural stimulus 124 and a percentage of the second binaural stimulus 126.

Depending on the frequency of the binaural stimuli and the physiology of the recipient, leakage can result in binaural summation or binaural cancellation. Binaural summation occurs when leakage of binaural stimuli causes the recipient to perceive a sound at an intensity that is greater than the actual intensity of the binaural stimuli. In other words, the recipient perceives a sound that is caused by binaural stimuli as being louder than a sound that is caused by a monaural stimulus, even though the intensity of the binaural stimulus is about the same as the intensity of the monaural stimulus.

In contrast, binaural cancellation occurs when leakage of binaural stimuli causes the recipient to perceive a sound at a lower intensity than the actual intensity of the binaural stimuli. In this case, the recipient perceives the sound caused by the binaural stimuli as being softer than a monaural stimulus that has about the same intensity.

In general, leakage tends to result in an average binaural summation benefit of about 3 dB. However, because leakage depends in large part on the physiology of the recipient, individual recipients may experience more or less of a summation benefit than 3 dB at one or more frequencies.

Calculating the binaural correction factor at one or more frequencies for the recipient may improve the fit of the stimulation devices 104, 106 to the recipient, thereby improving the recipient's experience and ability to more clearly perceive sounds over a wider range of frequencies. For instance, if the recipient experience binaural summation that is less than 3 dB at a given frequency, a phase shift can be applied in a corresponding frequency channel to improve the recipient's perception of sounds at the given frequency. Alternatively, determining that the recipient experience a summation benefit that is greater than 3 dB at a given frequency channel may result in a lower gain for the frequency channel, thereby conserving power in the stimulation devices 104, 106.

In a pre-operative setting, determining the binaural summation benefit the recipient experiences at one or more frequencies may be useful in determining whether the recipient would benefit from binaural hearing prostheses. If the recipient would benefit from binaural hearing prostheses, determining the binaural summation benefit the recipient experiences at the one or more frequencies may be useful in selecting one or more models of hearing prostheses that provide an optimal level of sound perception by the recipient.

In one example, the computing device 102 determines a setting of a parameter used by one of the stimulation devices 104, 106 to process sound, such as a gain or a maximum power offset, based on a binaural correction factor. In another example, the computing device 102 uses a statistic, such as an average of two or more binaural correction factors, to determine the setting of the parameter. In yet another example, the computing device 102 uses the lower of the monaural threshold intensity and the binaural threshold intensity for a frequency channel in order to determine the setting of a parameter at that frequency channel. A more detailed discussion of the fitting procedure is discussed herein with respect to FIG. 4.

The audiologist can also employ the system 100 in a pre-operative setting. The audiologist may use the system 100 to determine whether a potential recipient of one or more hearing prostheses would experience a benefit by having binaural hearing prostheses. For instance, the audiologist may evaluate whether a recipient of a single hearing prosthesis would experience improved sound recognition with binaural hearing prosthesis. In this example, the first stimulation device 104 is a hearing prosthesis, such as a bone conduction device, that is already implanted in the user.

The second stimulation device 106 is worn by the recipient and is configured to deliver stimuli 122, 126 to the recipient that are the same as or are similar to stimuli delivered by a hearing prosthesis, such as a bone conduction device. In another example, the audiologist uses the system 100 to evaluate the potential benefit of binaural hearing prostheses for a potential recipient who does not currently have a hearing prosthesis. In this example, both of the stimulation devices 104, 106 are worn by the recipient and are configured to deliver stimuli 120-126 that are the same as or are substantially similar to stimuli delivered by hearing prostheses.

The audiologist uses the computing device 102 to perform a diagnostic test that determines whether the recipient would benefit from having binaural hearing prostheses. The computing device 102 determines the monaural threshold intensities and the binaural threshold intensities for the stimulation devices 104, 106 at one or more frequencies.

For each of the one or more frequencies, the computing device 102 determines a binaural correction factor. The computing device 102 then determines whether the recipient would benefit from binaural hearing prostheses based on the binaural correction factors, perhaps by comparing the binaural correction factors to one or more metrics. Alternatively, the computing device 102 calculates a statistic based on two or more binaural correction factors, such as an average binaural correction factor, and compares the statistic to a metric in order to determine whether the recipient would receive a benefit from binaural hearing prostheses.

The computing device 102 may also display the binaural correction factor for each frequency on a display device to assist the audiologist in determining whether the recipient would benefit from binaural hearing prostheses. The displayed information may indicate a binaural benefit (e.g., a positive binaural correction factor), a binaural detriment (e.g., a negative binaural correction factor), or no binaural benefit (e.g., binaural correction factor is approximately zero).

In one example, the computing device 102 also determines prospective settings of one or more parameters of the binaural hearing prostheses based on the binaural correction factors. The computing device 102 identifies one or more potential hearing prostheses that can be configured with the prospective settings of the one or more parameters. This may assist the audiologist and the recipient in selecting an optimal configuration of bilateral hearing prostheses. When multiple hearing prostheses are capable of assisting the recipient in accurately perceiving sound, the computing device 102 displays the prospective hearing prostheses on a display device and recommends one of the hearing prostheses by identifying a prospective hearing prosthesis that has one or more characteristic features. A more detailed discussion of the diagnostic procedure is discussed with respect to FIG. 5.

Figure 2:
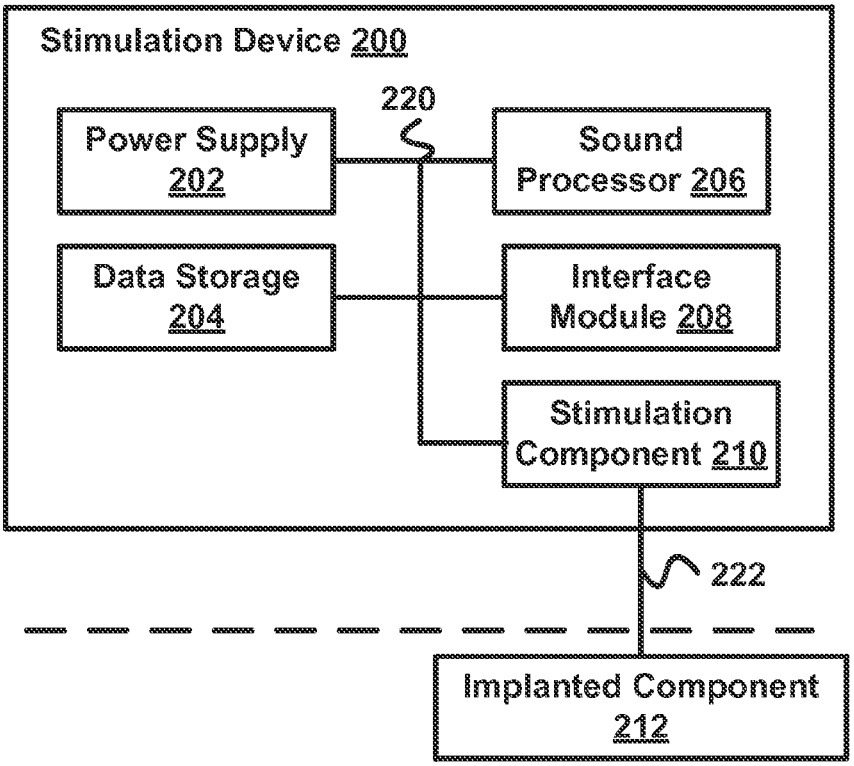
FIG. 2 is a block diagram of a stimulation device depicted in FIG. 1, according to an example.

FIG. 2 is a block diagram of a stimulation device 200. The stimulation device 200 is one example of the stimulation devices 104, 106 of the system 100. The stimulation device 200 includes a power supply 202, a data storage 204, a sound processor 206, an interface module 208, and a stimulation component 210, all of which are connected either directly or indirectly via circuitry 220. The stimulation device 200 also includes an implanted component 212 that is connected to the stimulation component 210 via a link 222. While the system 100 is used to describe certain aspects of the stimulation device 200 and other devices described herein, it is understood that other systems may be used.

In one example, the stimulation device 200 is a partially implantable hearing prosthesis, such as a bone conduction device. In this example, the implanted component 212 is implanted in a body of the user of the stimulation device 200, and the components 202-210 of the stimulation device 200 are contained in a single enclosure that the recipient wears externally on the user's body. Alternatively, the components 202-210 of the stimulation device 200 are contained in one or more connected enclosures that the user wears externally on the recipient's body.

In another example, the stimulation device 200 is a totally implantable hearing prosthesis, such as a totally implantable cochlear implant. In this example, the components 202-212 of the stimulation device 200 are implanted in the recipient's body in one or more enclosures. In yet another example, the stimulation device 200 is used in a pre-operative setting to determine if the recipient would benefit from bilateral hearing prostheses. In this example, the components 202-212 of the stimulation device 200 are included in one or more enclosures that are worn or placed externally on the recipient's body.

The power supply 202 supplies power to various components of the stimulation device 200 and can be any suitable power supply, such as a rechargeable or non-rechargeable battery. In one example, the power supply 202 is a battery that can be charged wirelessly, such as through inductive charging.

The data storage 204 includes any type of non-transitory, tangible, computer readable media now known or later developed configurable to store program code for execution by a component of the stimulation device 200 and/or other data associated with the stimulation device 200. For instance, the data storage 204 stores computer programs executable by the sound processor 206 and or a setting of one or more parameters used by the sound processor 206 to process a sound signal and/or a command signal received from the computing device 102.

The sound processor 206 receives a command signal from the interface module 208 and processes the command signal to generate a processed signal suitable for use by the stimulation component 210. In one example, the sound processor 206 is a digital signal processor. In another example, the sound processor 206 is any processor or combination of processors now known or later developed suitable for use in the stimulation device 200. Additionally, the sound processor 206 may include additional hardware for processing the sound signal, such as an analog-to-digital converter.

The sound processor 206 extracts information necessary for generating a stimulus from the command signal, and generates a processed signal that includes information usable by the stimulation component 210 for generating a stimulation signal. The processed signal includes information indicative of an intensity of a stimulus at one or more frequency channels. Each frequency channel corresponds to a frequency or a range of frequencies at which the stimulation component 210 and/or the implanted component 212 are configured to deliver stimuli to the recipient.

In one example, the sound processor 206 accesses the data storage 204 to process the command signal. In an example in which the stimulation device 200 is a hearing prosthesis, the sound processor 206 also receives a sound signal from an audio transducer (not shown), which includes information indicative of a sound received from the environment. The sound processor 206 processes the sound signal to generate the processed signal, which in this example includes information useable by the stimulation component 210 to generate the stimulation signal that allows the recipient to perceive at least a portion of the sound.

The interface module 208 receives an input from the computing device 102. In one example, the interface module 208 is configured to receive the command signal from the computing device 102 via one of the communication links 110, 112. The interface module 208 may also include one or more processors. If the stimulation device 200 is a hearing prosthesis, the interface module 208 also receives one or more settings of one or more parameters from the computing device 102. In this example, the interface module 208 stores the one or more settings in the data storage 204.

In one example, the interface module 208 connects the stimulation device 200 to the computing device 102 via a wireless interface. In another example, the interface module 208 connects the stimulation device 200 to the computing device 102 via a wired interface. In yet another example, the interface module 208 is configured to connect the stimulation device 200 to multiple devices. In this example, the interface module 208 includes one or more wireless and/or wired interfaces.

The stimulation component 210 receives the processed signal from the sound processor 206 and generates a stimulation signal based on the processed signal. The stimulation signal includes information usable by the implanted component 212 to generate the stimulus at one or more frequency channels. In an example in which the stimulation device 200 is (or simulates) a bone conduction device, the stimulation signal includes information for generating a stimulus as a mechanical output force in the form of a vibration.

In another example, the stimulation device 200 is a cochlear implant, and the stimulation component 210 generates the stimulation signal as an electrical signal capable of activating one or more electrodes of an electrode array implanted in one of the user's cochleae. In yet another example, the stimulation component 210 generates a stimulation signal that includes information suitable for generating a stimulus capable of allowing the recipient to perceive at least a portion of a sound.

The implanted component 212 receives the stimulation signal from the stimulation component 210 via the link 222. In an example in which the stimulation device 200 is a hearing prosthesis, the link 222 is a transcutaneous link or a percutaneous link. In an example in which the stimulation device 200 is used in a pre-operative setting, the implanted unit 212 is external to the recipient's body and may be incorporated in the stimulation component 210. In this example, the link 222 is a wired or a wireless link.

The implanted component 212 generates a stimulus based on the stimulation signal and delivers the stimulus to a body part in an auditory pathway of the recipient. In an example in which the stimulation device 200 is (or simulates) a bone conduction device, the implanted component 212 includes an anchor system. The anchor system delivers the stimulus to the user in the form of a vibration applied to a bone in the recipient's skull. The vibration causes fluid in the recipient's cochlea to move, thereby activating hair cells in the recipient's cochlea. The hair cells stimulate an auditory nerve, which allows the recipient to perceive at least a portion of a sound.

In another example, the stimulation device 200 is (or simulates) a cochlear implant, a direct acoustic stimulation device, a brain stem implant, a middle ear implant, or any other hearing prosthesis now known or later discovered. In this example, the implanted component 212 delivers an electrical stimulus, a mechanical stimulus, and/or any other stimulus or combination of stimuli capable of stimulating the body part in the recipient's auditory pathway that allows the recipient to perceive at least a portion of a sound.

Figure 3:
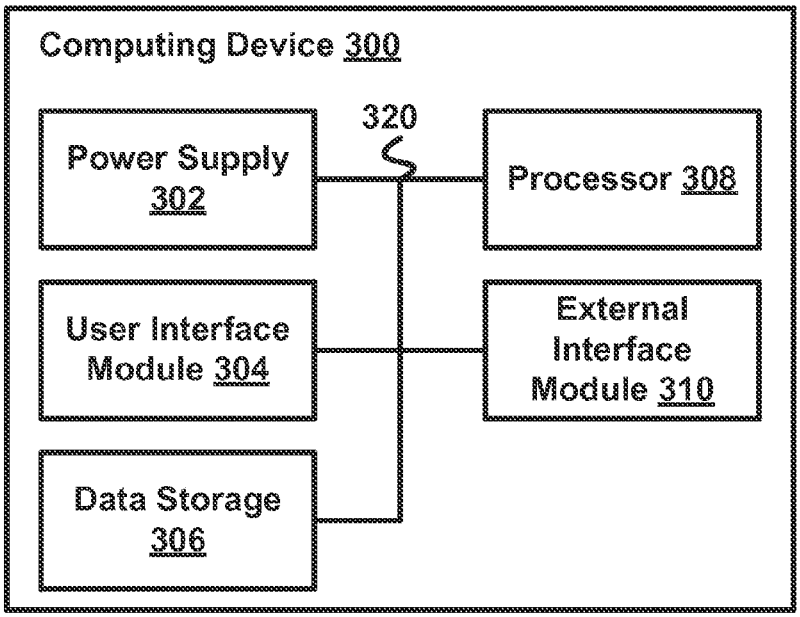
FIG. 3 is a block diagram of a computing device depicted in FIG. 1, according to an example.

FIG. 3 is a block diagram of a computing device 300. The computing device 300 is one example of the computing device 102 described in FIG. 1. The computing device 300 includes a power supply 302, a user interface module 304, a data storage 306, a processor 308, and an external interface module 310, all of which are connected either directly or indirectly via circuitry 320. An audiologist or a similar specialist uses the computing device 300 to determine a number of threshold intensities of a hearing prosthesis for a recipient.

The power supply 302 provides power to components of the computing device 300. In one example, the power supply 302 is connected to a mains power distribution, such as an electrical outlet that supplies 120 VAC power. The power supply 302 includes electrical equipment, such as one or more transformers, that are configured to reduce the power received from the mains power distribution to a voltage suitable for use by the component of the computing device 300. The power supply 302 also includes one or more AC-DC converters. In another example, the power supply 302 includes a rechargeable battery configured to supply power to the components of the computing device 302.

The user interface module 304 is configured to receive an input from a user of the computing device 300 and to provide an output to the user. The user interface module 304 includes at least one input component capable of receiving an input from the user, such as a keyboard, a keypad, a computer mouse, a touch screen, a track ball, a joystick, a camera, and/or any other similar device now known or later discovered.

The user interface module 304 may also include a device configured to receive data from the audiologist, such as a scanner or a data port. The user interface module 304 additionally includes at least one output component capable of displaying information to the user, such as a monitor, touch screen, printer, speaker, and/or any other similar device now known or later discovered. Furthermore, the user interface module 304 includes one or more processors, and any additional hardware and/or software, suitable for processing and generating signals in response to receiving inputs from the at least one input component and/or signals from the processor 308.

In one example, the user interface module 304 receives the input 114 from a user, such as the audiologist or the recipient, via the at least one input component and sends an input signal to the processor 308. For example, the recipient may raise a hand in response to perceiving a sound after receiving a monaural or binaural stimulus. The audiologist then interacts with the at least input component to indicate that the recipient did or did not perceive the sound. As another example, if the input component includes a camera, the user interface 304 identifies whether the recipient raised a hand after the monaural or binaural stimulus was delivered, and generates the input signal based on whether the recipient raised a hand. Or, the recipient may directly interact with the user interface 304 to provide an indication of whether the recipient perceived a sound.

Additionally, the user interface module 304 receives an output signal from the processor 308. The user interface module 304 outputs information included in the output signal via the at least one output component. For instance, if the output signal includes information for displaying one or more threshold intensities on a display device, the user interface module 304 displays the one or more threshold intensities on a display device included in the at least one output component.

The data storage 306 includes any type of non-transitory, tangible, computer readable media now known or later developed configurable to store program code for execution by the computing device 300 and/or other data associated with the computing device 300. The data storage 306 stores information used by the processor 308 to generate one or more commands signals. The data storage 306 may also store computer programs executable by the processor 308, such as computer programs that include instructions for performing one or more steps of the methods 400, 500, and/or 600 described herein. The data storage 306 also stores one or more intensities determined by the processor 308.

The processor 308 is configured to calculate one or more threshold intensities of stimuli generated by the stimulation devices 104, 106 at one or more frequencies. In a post-operative setting, the processor 308 is configured to determine one or more settings for one or more parameters of the stimulation devices 104, 106. The steps executed by the processor 308 to determine the one or more settings are described herein with respect to FIG. 4. In a pre-operative setting, the processor 308 is configured to determine whether the recipient or a potential recipient would benefit from bilateral hearing prostheses. The steps the processor 308 executes to make this determination are described herein with respect to FIG. 5. Additionally, the steps the processor 308 executes to determine a binaural threshold intensity are described with respect to FIG. 6.

To determine a threshold intensity for a given frequency channel, the processor 308 generates a command signal and sends the command signal to one or both of the stimulation devices 104, 106 via the external interface 310. For instance, if the processor 308 is determining a monaural threshold intensity, the processor 308 sends the command signal to one of the stimulation devices 104, 106 310. If the processor 308 is determining a binaural threshold intensity, the processor 308 sends the command signal about simultaneously to both of stimulation devices 104, 106.

In another example, the processor 308 generates a command signal for generating a stimulus at more than one frequency channel. For instance, the processor 308 may generate a command signal that includes information for reproducing a segment of recorded speech. In this example, the command signal includes information indicative of an intensity of a stimulus at one or more frequencies included in the segment of recorded speech.

The processor 308 also receives the input signal from the user interface module 304. The input signal includes information indicative of the recipient's perception of a stimulus or stimuli resulting from the transmission of a command signal. The processor 308 used the information indicative of the recipient's perception to determine a threshold intensity, as described herein with respect to FIGS. 4-6.

Additionally, the processor 308 generates one or more output signals that are sent to the user interface module 304. The output signal includes information indicative of one or more settings of binaural hearing prostheses, one or more binaural correction factors, one or more monaural threshold intensities, one or more binaural threshold intensities, and/or one or more recommended hearing prostheses for the recipient. Additionally, if the processor 308 identified one or more recommended hearing prostheses for the recipient when performing the steps described herein with respect to FIG. 5, the processor 308 includes information indicative of the one or more recommended hearing prostheses in the output signal.

In one example, the processor 308 receives information from an external device. For instance, if the computing device 300 is connected to a database through the external interface module 310, the processor 308 may access the database to identify information specific to the recipient, such as one or more audiograms. Alternatively, the processor 308 may receive the audiogram for the recipient via an input component of the user interface module 304. In another example, the processor 308 receives an activity signal from a device configured to measure neural activity in one or more of the recipient's auditory pathways. The processor 308 uses the information included in the activity signal, which may include objective indicia of the recipient's perception of a sound, when performing the steps described herein with respect to FIGS. 4-6.

The external interface module 310 connects the computing device 300 to the stimulation devices 104, 106 via the communication links 110, 112. Additionally, the external interface 310 may connect the computing device 300 to a device configured to measure neural activity in one or more of the recipient's auditory pathways. In this example, the external interface module 310 routes incoming signals, such as the activity signal, to the processor 309. In one example, the external interface module 310 connects the computing device 300 to the stimulation devices via a wired connection interface. In another example, the interface module 310 connects the computing device 300 to the stimulation devices via a wireless connection interface. In yet another example, the interface module 310 includes one or more wired and/or wireless connection interfaces.

Figure 4:
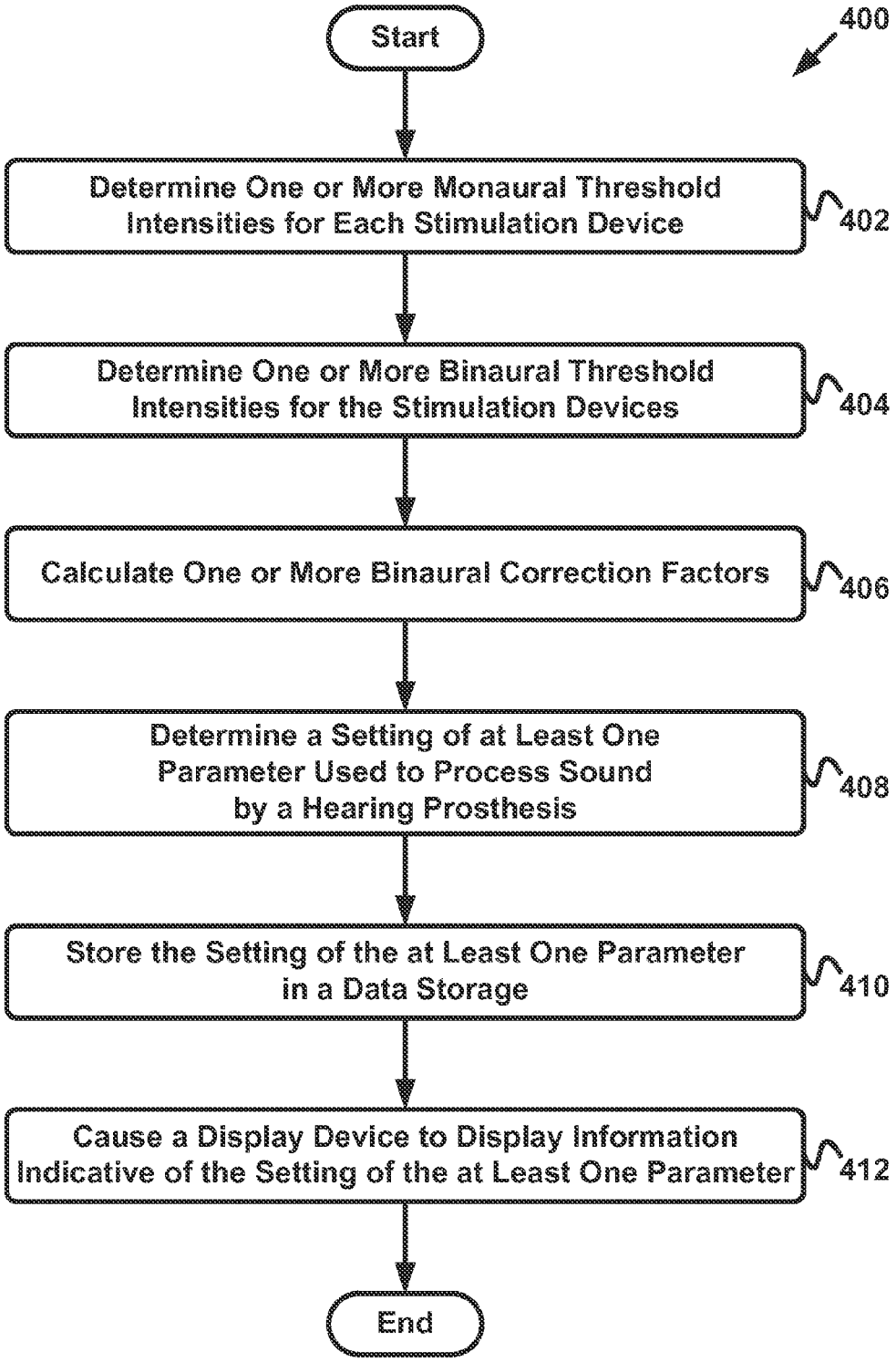
FIG. 4 is a flow diagram of a method for fitting binaural hearing prostheses, according to an example.

FIG. 4 is a block diagram of a method 400 for fitting binaural hearing prostheses. A processor performs the steps of one or more blocks of the method 400 to determine a setting of one or more parameters of one or more binaural hearing prostheses. While the system 100, the stimulation device 200, and the computing device 300 are described for purposes of illustrating the method 400 and other methods disclosed herein, it is understood that other devices may be used.

At block 402, the method 400 includes determining one or more monaural threshold intensities for each stimulation device. The processor 308 determines, for each of the stimulation devices 104, 106, one or more monaural threshold intensities. In one example, the processor 308 determines a monaural threshold intensity for each frequency channel of the stimulation devices 104, 106. In another example, the processor 308 determines a monaural threshold intensity for each frequency channel in a set of frequency channels.

The processor 308 employs any method, process, or algorithm now known or later developed to determine a monaural threshold intensity at the one or more frequencies. For instance, consider the following example in which the processor 308 determines a monaural threshold intensity for the first stimulation device 104 at a frequency channel $F_x$. An initial intensity of the monaural stimulus 120 corresponds to an intensity that results in the recipient perceiving a sound without damaging a body part in the recipient's first auditory pathway. The processor 308 determines the initial intensity based on an audiogram for the recipient's first auditory pathway. Alternatively, the audiologist enters the initial intensity for the monaural stimulus 120 via the user interface module 304.

The processor 308 generates a command signal that includes information indicative of the initial intensity and the frequency channel $F_x$ and sends the command signal to the external interface 310. The external interface 310 transmits the command signal to the first stimulation device 104 via the first communication link 110. Upon processing the command signal, the first stimulation device 104 generates and delivers the first monaural stimulus 120 to the recipient.

The recipient (or audiologist) interacts with an input component of the user interface module 304 to provide an indication of whether the recipient perceived a sound in response to receiving the monaural stimulus 120. When the intensity of the monaural stimulus 120 is the initial intensity, the user interface module 304 will typically receive the input 114 as indicating that the recipient perceived the sound. The user interface module 304 generates and sends an input signal that includes information indicative of the input to the processor 308.

Based on the input signal, the processor 308 reduces the intensity of the first monaural stimulus 120 and generates a second command signal, which is then transmitted to the first stimulation device 104 by the external interface module 310. The processor 308 repeats this process until the input 114 includes information indicative of the recipient not perceiving the sound after receiving the first monaural stimulus 120. The processor 308 determines that the intensity level of the last stimulus that caused the recipient to perceive the sound is the monaural threshold intensity for the first stimulation device 104 at the frequency channel $F_x$. The processor 308 stores the monaural threshold intensity in the data storage 306.

At block 404, the method 400 includes determining one or more binaural threshold intensities. For each of the stimulation devices 104, 106, the processor 308 determines a binaural threshold intensity at the one or more frequency channels. In one example, the processor 308 determines a binaural threshold intensity at each frequency channel at which a monaural threshold intensity is determined. For instance, if the processor 308 determines a monaural threshold intensity at each of M frequency channels, where M is a positive integer, the processor 308 determines a binaural threshold intensity corresponding to each of the same M frequency channels. In another example, the processor 308 determines binaural threshold intensities for more or fewer frequency channels than the number of frequency channels at which monaural threshold intensities are determined. A method for determining a binaural threshold intensity is described herein with respect to FIG. 6.

At block 406, the method 400 includes calculating one or more binaural correction factors. The processor 308 determines a binaural correction factor for each frequency channel at which the processor 308 determined a monaural threshold intensity and a binaural threshold intensity. For each frequency channel, the processor 308 calculates the difference between the monaural threshold intensity and the binaural threshold intensity, and stores the difference as the binaural correction factor for the corresponding frequency channel in the data storage 306.

At block 408, the method 400 includes determining a setting of at least one parameter used to process a sound by a hearing prosthesis. In one example, the processor 308 determines the setting of the at least one parameter at a given frequency based on one or more binaural correction factors. In one example, the setting of the at least parameter corresponds to a particular binaural correction factor or a range of binaural correction factors.

The processor 308 determines the setting of the at least one parameter based on the final threshold intensity of the associated frequency, perhaps by referencing a look-up table stored in the data storage 306. In this example, the at least one parameter is a gain, threshold, phase offset, and/or the like. For instance, the processor 308 calculates a phase offset for a frequency channel when the binaural correction factor is below a threshold binaural correction factor. The processor 308 calculates a phase offset that minimizes the amount of binaural cancellation.

In another example, the processor 308 uses a statistic of the binaural correction factors, such an average binaural correction factor, to determine the setting of a parameter. For instance, if the computing device did not determine a binaural threshold intensity for frequency channel $F_x$, the processor 308 determines a setting of a parameter at frequency channel $F_x$ based on the average binaural correction factor. The average binaural correction factor may be an average of all binaural corrections factors, or the average may be based on a subset of binaural correction factors, such as binaural correction factors corresponding to the frequency channel above and below frequency channel $F_x$.

In an additional example, the setting of the at least one parameter at a given frequency depends on a final threshold frequency. A final threshold intensity at a given frequency is the lesser of the monaural threshold intensity and the binaural threshold intensity at that frequency. The processor 308 compares a monaural threshold intensity to a binaural threshold intensity at the frequency to identify the lesser of the two threshold intensities. In this example, a setting of a parameter, such as a gain or a maximum power offset, corresponds to a specific final threshold intensity or a range of final threshold intensities. The processor 308 determines the setting of the at least one parameter based on the final threshold intensity of the associate frequency, perhaps by referencing a look-up table stored in the data storage 306.

At block 410, the method 400 includes storing the setting of the at least one parameter in a data storage. In one example, the processor 308 stores the setting of the at least one parameter in an internal data storage, such as the data storage 306. In another example, the processor 308 stores the at least one parameter in an external data storage. For example, the processor 308 transmits the setting of the at least one parameter for the first stimulation device 104 via the communication link 110. The first stimulation device 104 receives the setting and stores the setting in the data storage 204. In yet another example, the processor 308 may export the setting to an external computing device, such as a database for storage in a data storage.

At block 412, the method 400 includes causing a display device to display information indicative of the setting of the at least one parameter. The processor 308 sends an output signal to the user interface module 304 that includes information indicative of the setting of the at least one parameter. The user interface module 304 processes the output signal and causes one or more output components of the user interface module 304, such as a touch screen, computer monitor, television, and/or the like, to display information indicative of the setting of the at least one parameter.

In one example, the output signal includes additional information, such as information indicative of one or more monaural threshold intensities, one or more binaural threshold intensities, and/or one or more binaural correction factors. In this example, the user interface module 304 also causes the output component to display the additional information. After completing the steps of block 412, the method 400 ends.

Figure 5:
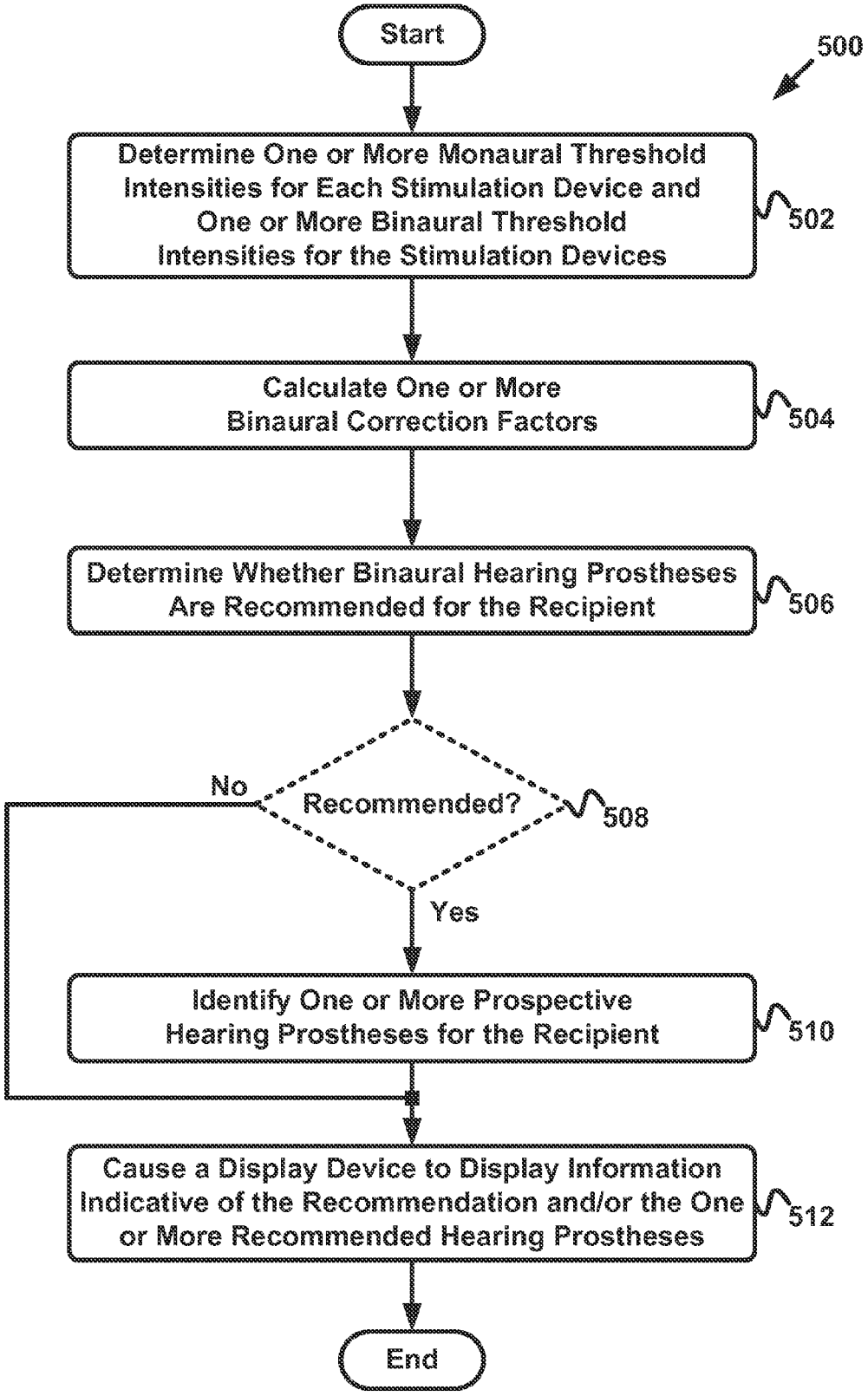
FIG. 5 is a flow diagram of a method for determining a benefit of binaural hearing prostheses, according to an example.

FIG. 5 is a flow diagram of a method 500 for determining a benefit of binaural hearing prostheses. A processor employs the method 500 to determine whether a recipient would benefit from binaural hearing prostheses. The computing device may also use the method 500 to identify one or more specific hearing prostheses to include in a binaural hearing prosthesis system based on the recipient's ability to perceive sounds after receiving stimuli from two stimulation devices.

At block 502, the method 500 includes determining one or more monaural threshold intensities for each stimulation device and one or more binaural threshold intensities for the stimulation devices. The steps of blocks 502 are the same as or are substantially similar to the steps performed with respect to blocks 402-404 of the method 400. At block 504, the method 500 includes determining one or more binaural correction factors. The steps of block 504 are the same as or are substantially similar to the steps performed with respect to block 406 of the method 400.

At block 506, the method 500 includes determining whether binaural hearing prostheses are recommended for the recipient. The processor 308 compares the one or more binaural correction factors to one or more threshold correction factors. If N of the binaural correction factors are greater than an associated threshold binaural correction factor, the recipient experienced binaural summation over at least N frequencies. In this event, the processor 308 determines that the recipient would benefit from binaural hearing prostheses and that binaural hearing prostheses are recommended for the recipient. Otherwise, the processor 308 determines that the recipient does not experience enough binaural summation to justify the use of binaural hearing prostheses, and the processor 308 determines that the binaural hearing prostheses are not recommended for the recipient. A value of N, which is an integer, may be established at the point of manufacture and/or may be set by the audiologist.

Alternatively, the processor 308 determines a prospective setting of one or more parameters of the binaural hearing prostheses in response to determining that recipient would not benefit from binaural hearing prostheses. For instance, notwithstanding the lack of a binaural benefit, the audiologist (or possibly the processor 308) may determine that the recipient would still benefit from binaural hearing prostheses because of head shadowing. To determine the prospective setting, the processor 308 may employ the steps of one or more of blocks 408-412 of the method 400. The prospective settings may improve the effectiveness of the binaural hearing prostheses by optimizing the settings to minimize the impact of binaural interference on the recipient's ability to perceive sound.

At block 508, the method 500 includes an optional decision point. The audiologist causes the processor 308 to skip the steps of block 508 if the audiologist wants a list of recommended hearing prostheses regardless of whether the binaural hearing prostheses are recommended for the recipient. If the processor 308 determined that binaural hearing prostheses are recommended for the recipient, the method 500 continues at block 510. Otherwise, the method 500 proceeds to block 512.

At block 510, the method 500 includes identifying one or more recommended hearing prostheses for the recipient. The processor 308 determines one or more prospective settings of one or more parameters used by a hearing prosthesis to process sound. The one or more parameters include a gain and/or a maximum power offset at one or more frequencies. The processor 308 determines the one or more prospective settings by performing the same or substantially similar steps as described with respect to block 408 of the method 400. The processor 308 then accesses a database of available hearing prostheses, which may be stored in the data storage 306 or an external database, and identifies one or more prospective hearing prostheses, if any, that can be configured with the one or more prospective settings. For example, if the one or more parameters include a gain, the processor 308 identifies one or more hearing prostheses that can be configured to the one or prospective settings of the gain.

In one example, the processor 308 also identifies a hearing prosthesis having one or more characteristic features as a preferred hearing prosthesis. The recipient or audiologist may select one or more characteristic features using the input component of the user interface module 304. The processor 308 then identifies the hearing prosthesis from the one or more prospective hearing prostheses having one or more characteristic features as the preferred hearing prosthesis.

For instance, the processor 308 may identify hearing prosthesis A and hearing prosthesis B as being able to process sound using the one or more prospective settings of the one or more parameters, but hearing prosthesis A consumes power at a lower rate than hearing prosthesis B. If lower power consumption is the characteristic feature, the processor 308 identifies hearing prosthesis A as the preferred hearing prosthesis. If the recipient (or audiologist) selects additional characteristic features, such as sharper frequency resolution, broader gain profile, faster sound processor speed, or the like, the processor 308 identifies the hearing prosthesis included in the one or more potential hearing prostheses that has more characteristic features as the preferred hearing prosthesis.

As another example, the additional characteristic feature is the ability to binaurally process data by communicating with another hearing prosthesis. In an example in which the recipient would receive a binaural benefit, binaural processing sounds received by both hearing prostheses in a binaural hearing prosthesis system may provide additional localization and loudness cues, improving the recipient's ability to perceive sound like a person with normal hearing. Alternatively, if the recipient does not receive a binaural benefit, the characteristic feature may include asynchronous operability, i.e. the preferred hearing prosthesis does not need to communicate with another hearing prosthesis in order to function in a binaural hearing prosthesis system.

At block 512, the method 500 includes causing a display device to display information indicative of the recommendation and, when applicable, one or more prospective hearing prostheses. The processor 308 generates an output signal that includes information indicative of the recommendation and sends the output signal to the user interface module 304. The user interface module 304 processes the output signal and causes one or more output components to display information indicative of the recommendation, perhaps in the form of a dialog box indicating whether binaural hearing prostheses are recommended.

If the recommendation is that the recipient would benefit from binaural hearing prostheses, the processor 308 includes information indicative of the one or more prospective hearing prostheses in the output signal, and the user interface module 304 causes the one or more output components to display information indicative of the one or more prospective hearing prostheses. If the processor 308 identified a preferred hearing prosthesis at block 510, the processor 308 includes information indicative of the preferred hearing prosthesis in the output signal, and the user interface module 304 also causes the one or more output components to display information indicative of the preferred hearing prosthesis.

Additionally, the processor 308 may include additional information in the output signal, such as information indicative of one or more monaural threshold intensities, one or more binaural threshold intensities, and/or one or more binaural correction factors. The user interface module 304 also causes the one or more output components to display the additional information, which assists the audiologist in making an independent assessment of the recommendation and to explain the recommendation to the recipient. After completing the steps of block 502, the method 500 ends.

Figure 6:
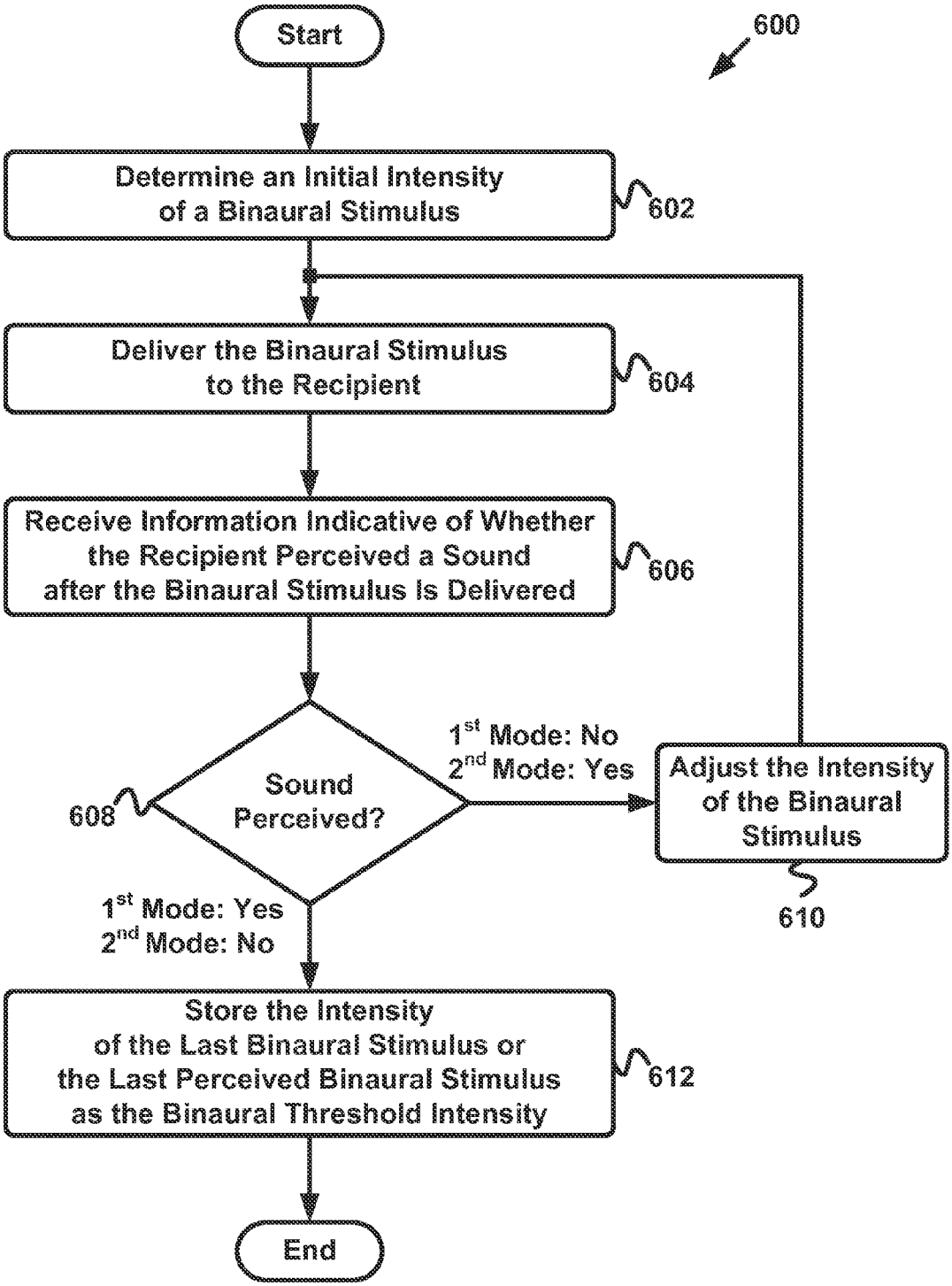
FIG. 6 is a flow diagram of a method for determining a binaural threshold intensity of a binaural stimulus, according to an example.

FIG. 6 is a flow diagram of a method 600 for determining a binaural threshold intensity. A computing device performs the steps of the method 600 to determine a binaural threshold intensity for stimulation devices at a given frequency. The method 600 is one example of the steps a processor performs when performing the steps of block 404 of the method 400 or block 502 of the method 500. For illustrative purposes, the method 600 is described with respect to the frequency channel $F_x$.

At block 602, the method 600 includes determining an initial intensity of a binaural stimulus. As previously described, the intensity of the first binaural stimulus 124 is about the same as the intensity of the second binaural stimulus 126. The processor 308 determines an initial intensity of the binaural stimuli 124, 126 based on the monaural threshold intensities of the stimulation devices 104, 106 at the frequency channel $F_x$. In one example, the processor 308 selects the greater of the two monaural threshold intensities at frequency channel $F_x$ as the initial intensity.

In another example, the processor 308 selects the lesser of the two monaural threshold intensities at the frequency channel $F_x$ as the initial intensity. Additionally, the processor 308 may apply an offset to the selected monaural threshold intensity when determining the initial intensity of the binaural stimuli 124, 126. Applying the offset to the selected monaural threshold intensity increases the likelihood that the recipient perceives a sound at a frequency corresponding to the frequency channel $F_x$ when the intensity of the binaural stimuli 124, 126 is the initial intensity.

Other examples are also possible. For instance, the processor 308 may calculate an average of the monaural threshold intensities at frequency channel $F_x$ and use the average as the initial binaural intensity. Alternatively, the audiologist enters the initial intensities of the binaural stimuli directly into the processor 308 via an input component of the user interface module 304.

At block 604, the method 600 includes delivering the binaural stimuli to the recipient. The processor 308 generates a command signal that includes information indicative of the intensity and the frequency channel used to generate the binaural stimuli 124, 126. The processor 308 sends the command signal to the external interface module 310, and the external interface module 310 transmits the command signal to the stimulation devices 104, 106 via the respective communication channels 110, 112.

In one example, the external interface 310 transmits the command signal to first stimulation device 104 and the second stimulation device 106 at about the same time. In another example, such as when the stimulation devices 104, 106 are different stimulation devices, the external interface module 310 delays sending the command signals to one of the stimulation devices 104, 106. Delaying the transmission of the command signal to one of the stimulation devices 104, 106 increases the likelihood that the binaural stimuli 124, 126 are delivered to the recipient approximately simultaneously.

The stimulation devices 104, 106 generate the binaural stimuli 124, 126, respectively, in response to receiving the command signal. The first stimulation device 104 delivers the first binaural stimulus 124 to the recipient approximately simultaneously to the second stimulation device 106 delivering the second binaural stimulus 124 to the recipient.

At block 606 the method 600 includes receiving information indicative of whether the recipient perceived a sound after the binaural stimuli are delivered. When the intensity of the binaural stimuli is greater than or equal to the binaural threshold intensity, the recipient perceives a sound, such as a tone, at a frequency corresponding to frequency channel $F_x$. The recipient interacts with an input component of the user interface module 304, such as a keyboard, computer mouse, touch screen, camera, or the like, to provide an indication of whether the recipient perceived a sound after receiving the binaural stimuli 124, 126 (i.e., the input 114). Alternatively, the audiologist interacts with the input component of the user interface module 304 to provide the indication. The user interface module 304 receives the input 114 from the recipient (or audiologist), generates the input signal, and transfers the input signal to the processor 308.

Recall that, at a basic level, the input 114 indicates whether the recipient perceived or did not perceive the sound after the first stimulation device 104 delivered the stimulus. For instance, the user interface module 304 causes one or more output components included in the user interface module 304 to display two interactive icons. The recipient interacts with the user interface module 308 via the input component to select one of the two interactive icons.

For example, the recipient selects a first interactive icon to indicate that the recipient perceived the sound, and the recipient selects a second interactive icon to indicate that the recipient did not perceive the sound. Additionally, the recipient may provide an indication of the perceived loudness of the sound by interacting with another icon, group of icons, or other graphical display of loudness. The user interface 304 generates the input signal based on the input 114 received from the recipient and sends the input signal to the processor 308.

In another example, the computing device 102 receives information indicative of the recipient's perception of sound from an external device, such as a device configured to measure neural activity of the recipient's auditory pathways. The device records the neural activity in the recipient's auditory pathways, which may include neural activity in the recipient's auditory nerves and/or auditory cortex, and includes the neural activity in the activity signal. The device transmits the activity signal to the computing device 102, and the external interface module 310 receives and transfers the activity signal to the processor 308.

At block 608, the method 600 includes determining whether the recipient perceived the sound. In one example, the processor 308 processes the input signal to determine whether the recipient perceived the sound. In another example, the processor 308 processes the activity signal to determine whether the recipient perceived the sound after receiving the binaural stimuli 124, 126. The processor 308 may use the activity signal instead of or in addition to the input signal when determining whether the recipient perceived the sound. In some situations, using objective indicia (e.g., measurements of neural activity) provides a faster, and perhaps more accurate, determination of whether the recipient perceived the sound as compared to using subjective indicia (e.g., recipient providing an indication of the perception of the sound). In yet another example, the processor 308 receives information indicative of whether the recipient perceived the sound receiving the binaural stimuli 124, 126 via any means now known or later discovered suitable for use by the processor 308.

When the steps of block 608 are performed for the first time (i.e., the intensity of the binaural stimuli 124, 126 is the initial intensity), the processor 308 determines an adjustment mode. If the recipient did not perceive the sound after receiving the binaural stimuli 124, 126 at the initial intensity, then the adjustment mode is a first adjustment mode ("$1^{st}$ Mode in FIG. 6"). Otherwise, the adjustment mode is a second mode ("$2^{nd}$ mode" in FIG. 6). In this manner, the processor 308 performs the steps of block 610 at least once during each performance of the method 600.

In the first mode, if the processor 308 determines that the recipient did not perceive the sound, then the method 600 includes proceeding to block 610 of the method 600. If the processor 308 determines that the recipient perceived the sound, then the method 600 includes proceeding to block 612 of the method 600. In the second adjustment mode, if the processor 308 determines that the recipient perceived the sound, then the method 600 includes proceeding to block 610 of the method 600. If the processor 308 determines that the recipient did not perceive the sound, then the method 600 includes proceeding to block 612 of the method 600.

At block 610, the method 600 includes adjusting the intensity of the binaural stimulus. The processor 308 applies an adjustment factor to the intensity of the last perceived binaural stimulus to provide an adjusted intensity. In the first adjustment mode, the adjustment factor is an addition factor, while in the second adjustment mode the adjustment factor is a reduction factor. Additionally, when in the second operating mode, the processor 308 stores the intensity of the binaural stimuli 124, 126 as the intensity of the last perceived binaural stimuli in the data storage 306 prior to applying the adjustment factor to the intensity of the binaural stimuli 124, 126.

In one example, the adjustment factor is based on an operating characteristic of the stimulation devices 104, 106. For instance, if the stimulation devices 104, 106 deliver stimuli at a plurality of intensity levels, the adjustment factor is one intensity level. Alternatively, the audiologist enters the adjustment factor via the input component of the user interface module 304 based on the operating characteristic of stimulation devices 104, 106 and/or the recipient's perception of the loudness of the last perceived binaural stimulus.

In an example in which the adjustment mode is the second adjustment mode, the processor 308 calculates the adjustment factor based on the perceived loudness of the sound. The processor 308 calculates the adjustment factor based on the perceived loudness indicated by the input signal and/or the activity signal, when received. The processor 308 calculates the adjustment factor based on the information indicative of the neural activity. Alternatively, the processor 308 references a look-up table stored in the data storage 306 to determine the adjustment factor based on the perceived loudness. In these examples, the processor 308 calculates the adjustment factor to reduce the time the processor 308 takes to determine the binaural threshold intensity at the frequency channel $F_x$. That is, the processor 308 calculates the adjustment factor such that adjusted intensity is close to the binaural threshold intensity, but not less than the binaural threshold intensity.

For instance, consider an example in which the perceived loudness of a stimulus is rated (either by the recipient or as a function of neural activity) on a scale of zero to ten. When the perceived loudness is zero, the recipient does not perceive the sound. If the perceived loudness is greater than one, the processor 308 calculates the adjustment factor so as to provide an adjusted intensity of the binaural stimulus that, when delivered to the recipient, causes the recipient to perceive the sound as having a perceived loudness of about one. Calculating the adjustment factor in this manner reduces a likelihood that the processor 308 incorrectly identifies the binaural threshold intensity. In one example, if the processor 308 calculates an adjustment factor greater than a threshold reduction factor and the recipient does not perceive the sound after receiving the binaural stimulus at the adjusted intensity, the processor 308 is configured to return to block 610 of the method 600 in order to recalculate the adjustment factor, notwithstanding the flow chart in FIG. 6.

After completing the steps of block 610, the method 600 includes returning to block 604 to deliver binaural stimuli 124, 126 to the recipient at the adjusted intensity.

At block 612, the method 600 includes storing the intensity of the last binaural stimulus or the last perceived binaural stimulus as the binaural threshold intensity. When in the first adjustment mode, the processor 308 determines that the intensity of the last binaural stimulus (i.e., the first intensity of the binaural stimuli 124, 126 that caused the recipient to perceive the sound) is the binaural threshold intensity at the frequency channel $F_x$. The processor 308 stores this intensity in the data storage 308 as the binaural threshold intensity at the frequency channel $F_x$.

When in the second adjustment mode, if the processor 308 determines that the recipient did not perceive a sound after receiving the binaural stimuli 124, 126 at block 608, the processor 308 determines that the intensity of the last perceived binaural stimulus is the binaural threshold intensity. The processor 308 stores the intensity of the last perceived binaural stimulus at frequency $F_x$ as the binaural threshold intensity for the frequency $F_x$ in the data storage 306.

For example, consider a situation in which the recipient perceives a sound when the intensity of the binaural stimuli 124, 126 is I. The processor 308 stores I as the intensity of the last perceived binaural stimulus and reduces the intensity by R to provide an adjusted intensity of I-R. The processor 308 generates a second command signal that includes information indicative of the reduced intensity, and, after performing the steps of block 604-608, the processor 308 determines that the recipient does not perceive the sound in response to receiving the binaural stimuli 124, 126 at the adjusted intensity. Upon determining that the recipient did not perceive the sound when at the adjusted intensity, the processor 308 determines that the binaural threshold intensity of the stimulation devices 104, 106 at the frequency channel $F_x$ is I. The processor 308 stores the binaural threshold intensity in the data storage 306.

After performing the steps of block 612, the method 700 ends. The processor 308 may perform additional iterations of the method 600 for additional frequency channels when performing the steps of block 404 of the method 400.

As previously indicated, the above-described systems, devices, and methods are directed toward examples in which the intensities and/or phases of the binaural stimuli are about the same. An audiologist can also use the systems, devices, and methods described herein in an example in which binaural stimuli have different intensities and/or phases.

For example, the audiologist may employ the components of the system 100 and one or more steps of the methods 400-600 to perform a localization procedure. In this example, the intensity of the binaural stimuli 124, 126 is sufficiently high to cause the recipient to perceive a sound, and, after receiving the binaural stimuli 124, 126, the recipient (or audiologist) provides the input 114 to the computing device 102 via an input component of the user interface 304. In this example, the input 114 includes information indicative of a perceived location of the sound's source (e.g., to the right of the recipient, in front of the recipient, etc.), The computing device 102 may calculate a binaural correction factor based on a difference between the perceived location and an actual location of the source (e.g., the location of the source relative to the recipient if the recipient had received the sound from the source). Additionally or alternatively, the computing device 102 may determine a setting of one or more parameters of the stimulation devices 104, 106 that, when applied, cause the recipient to perceive the location of the source as the actual location. Other examples are also possible.

With respect to any or all of the message flow diagrams, scenarios, and flow charts in the figures and as discussed herein, each step, block and/or communication may represent a processing of information and/or a transmission of information in accordance with example embodiments. Alternative embodiments are included within the scope of these example embodiments. In these alternative embodiments, for example, functions described as steps, blocks, transmissions, communications, requests, responses, and/or messages may be executed out of order from that shown or discussed, including in substantially concurrent or in reverse order, depending on the functionality involved. Further, more or fewer steps, blocks and/or functions may be used with any of the message flow diagrams, scenarios, and flow charts discussed herein, and these message flow diagrams, scenarios, and flow charts may be combined with one another, in part or in whole.

A step or block that represents a processing of information may correspond to circuitry that can be configured to perform the specific logical functions of a herein-described method or technique. Alternatively or additionally, a step or block that represents a processing of information may correspond to a module, a segment, or a portion of program code (including related data). The program code may include one or more instructions executable by a processor for implementing specific logical functions or actions in the method or technique. The program code and/or related data may be stored on any type of computer-readable medium, such as a storage device, including a disk drive, a hard drive, or other storage media.

The processor may include a microprocessor formed on a wafer. The processor may also include one or more microprocessors configured to execute one or more portions of the program code in parallel. The one or more microprocessors may be formed on a single wafer, included in an integrated circuit, and/or otherwise connected to facilitate exchanging data when executing the program code.

The computer-readable medium may include non-transitory computer-readable media such as computer-readable media that stores data for short periods of time like register memory, processor cache, and/or random access memory (RAM). The computer-readable medium may also include non-transitory computer-readable media that stores program code and/or data for longer periods of time, such as secondary or persistent long term storage, like read only memory (ROM), optical or magnetic disks, and/or compact-disc read only memory (CD-ROM), for example. The computer-readable medium may additionally include any other volatile or non-volatile storage systems. A computer-readable medium may be considered a computer-readable storage medium, for example, or a tangible storage device.

Moreover, a step or block that represents one or more information transmissions may correspond to information transmissions between software and/or hardware modules in the same physical device. However, other information transmissions may be between software modules and/or hardware modules in different physical devices.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A non-transitory computer-readable memory having stored therein instructions executable by a computing device to cause the computing device to perform functions comprising:

determining one or more monaural threshold intensities corresponding to a plurality of monaural stimuli;

determining one or more binaural threshold intensities corresponding to a plurality of binaural stimuli; and calculating one or more binaural correction factors, wherein a binaural correction factor at a frequency is a difference between the monaural threshold intensity at the frequency and the binaural threshold intensity at the frequency;

wherein at least one setting is applied based on the determined one or more binaural correction factors.

2. The non-transitory computer readable memory of claim 1, wherein the functions further comprise:

determining, as the at least one setting, one or more settings of one or more parameters used by a hearing prosthesis to process sound at one or more frequencies included in the plurality of frequencies based on one or more binaural correction factors included in the plurality of binaural correction factors.

3. The non-transitory computer readable memory of claim 2, wherein the functions further comprise:

identifying one or more prospective hearing prostheses from a plurality of hearing prostheses capable of being configured with the one or more settings of the one or more parameters; and causing a display device to display information indicative of the one or more hearing prostheses.

4. The non-transitory computer readable memory of claim 1, wherein the functions further comprise:

calculating an average of the one or more binaural correction factors;

comparing the average to a threshold binaural correction factor;

making a determination that the recipient would benefit from the binaural hearing prostheses if the average is greater than or equal to the threshold binaural correction factor; and causing a display device to display information indicative of the determination.

5. The non-transitory computer readable memory of claim 1, wherein the functions further comprise:

causing a display device to display information indicative of at least one of:

one or more monaural threshold intensities included in the plurality of monaural threshold intensities;

one or more binaural threshold intensities included in the plurality of binaural threshold intensities; or one or more binaural correction factors included in the plurality of binaural correction factors.

6. The non-transitory computer readable memory of claim 1, wherein:

each monaural stimulus is delivered to a body part in a first auditory pathway of a recipient and causes the recipient to perceive a first sound at a frequency included in a plurality of frequencies, and wherein each monaural threshold intensity is an intensity of a monaural stimulus below which the recipient is unable to perceive the first sound; and each binaural stimulus is delivered to the body part in the first auditory pathway and a body part in a second auditory pathway of the recipient about simultaneously and causes the recipient to perceive a second sound having a frequency included in the plurality of frequencies, and wherein each binaural threshold intensity is an intensity of a binaural stimulus below which the recipient is unable to perceive the second sound.

7. A system comprising:

a first stimulation device;

a second stimulation device; and a computing device connected to the first stimulation device and the second stimulation device that is configured to:

cause the first stimulation device to deliver a binaural stimulus at about the same time as the second stimulation device delivers the binaural stimulus, adjust an intensity of the binaural stimulus to identify a lowest intensity of the binaural stimulus at which the recipient is able to perceive sound from the binaural stimulus, wherein the lowest intensity of the binaural stimulus defines a binaural threshold intensity for the first stimulation device and the second stimulation device, determine a first monaural threshold intensity that is an intensity of a first monaural stimulus delivered to the recipient by the first stimulation device and is a lowest intensity of the first monaural stimulus at which the recipient perceives sound from the first monaural stimulus;

determine a second monaural threshold intensity that is an intensity of a second monaural stimulus delivered to the recipient by the first stimulation device and is a lowest intensity of the second monaural stimulus at which the recipient perceives sound from the second monaural stimulus; and determine at least one parameter used by a hearing prosthesis to process sound at a frequency based in part on the binaural threshold intensity and at least one of the first monaural threshold intensity and the second monaural threshold intensity.

8. The system of claim 7, wherein the setting of the at least one parameter is based on the lower of the binaural threshold intensity, the first monaural threshold intensity, and the second monaural threshold intensity.

9. The system of claim 7, wherein the computing device is further configured to:

determine a binaural correction factor, wherein the binaural correction factor is a difference between:

the greater of the first monaural threshold intensity and the second monaural threshold intensity; and the binaural threshold intensity, wherein the setting of the at least one parameter is based on the binaural correction factor.

10. The system of claim 7, wherein the computing device is further configured to:

calculate a binaural correction factor, wherein the binaural correction factor is a difference between:

the lesser of the first monaural threshold intensity and the second monaural threshold intensity; and the binaural threshold intensity, wherein the setting of the at least one parameter is based on the binaural correction factor.

11. A device comprising a processor configured to:

determine a binaural threshold intensity for stimulation devices at a frequency channel based on whether a recipient perceives a sound at a frequency corresponding to the frequency channel in response to receiving one or more binaural stimuli, wherein the binaural threshold intensity is an intensity of a binaural stimulus below which the recipient is unable to perceive the sound at the frequency corresponding to the frequency channel in response to receiving the one or more binaural stimuli;

determine a monaural threshold intensity for a first one of the stimulation devices at the frequency channel based on whether the recipient perceives sound at the frequency corresponding to the frequency channel in response to receiving one or more monaural stimuli, wherein the monaural threshold intensity is an intensity of a monaural stimulus below which the recipient is unable to perceive the sound at the frequency corresponding to the frequency channel in response to receiving one or more monaural stimuli, determine a binaural correction factor for the first stimulation device based on a difference between the binaural threshold intensity and the monaural threshold intensity, and establish a setting for the first stimulation device based on the binaural correction factor.

12. The device of claim 11, further comprising:

a data storage that includes an intensity of a last binaural stimulus at the frequency, wherein the last binaural stimulus is one of the one or more binaural stimuli; and an external interface component configured to send one or more signals to the binaural stimulation devices, wherein, to determine the binaural threshold intensity, the processor is further configured to:

apply an adjustment factor to the intensity of the last binaural stimulus to provide an adjusted intensity;

generate a command signal that includes information indicative of a next binaural stimulus having the adjusted intensity at the one or more frequencies;

send the command signal to the binaural stimulation devices, wherein the command signal causes the binaural stimulation devices to deliver the next binaural stimulus to the recipient at about the same time; and determine whether the recipient perceived sound at the frequency in response to receiving the next binaural stimulus.

13. The device of claim 12, wherein the adjusted intensity is less than the intensity of the last binaural stimulus, and wherein the processor, in response to determining that recipient failed to perceive sound in response to receiving the next binaural stimulus, is further configured to determine that the intensity of the last binaural stimulus is the binaural threshold intensity.

14. The device of claim 12, wherein the adjusted intensity is greater than the intensity of the last binaural stimulus, and wherein the processor, in response to determining that the recipient perceived sound in response to receiving the next binaural stimulus, is further configured to store the adjusted intensity in the data storage as the binaural threshold intensity for the frequency.

* * * * *